US006313806B1

(12) United States Patent
Schadler

(10) Patent No.: US 6,313,806 B1
(45) Date of Patent: Nov. 6, 2001

(54) SLOT ANTENNA WITH SUSCEPTANCE REDUCING LOOPS

(75) Inventor: John Schadler, Raymond, ME (US)

(73) Assignee: General Signal Corporation, Muskegon, MI (US)

( * ) Notice: Subject to any disclaimer, the term of this patent is extended or adjusted under 35 U.S.C. 154(b) by 0 days.

(21) Appl. No.: 09/501,742

(22) Filed: Feb. 11, 2000

(51) Int. Cl.[7] ..... H01Q 13/12; H01Q 21/08
(52) U.S. Cl. ..... 343/767; 343/770
(58) Field of Search ..... 343/767, 770, 343/771, 890; H01Q 13/12, 21/08

(56) References Cited

U.S. PATENT DOCUMENTS

| | | | | |
|---|---|---|---|---|
| 2,658,143 | * | 11/1953 | Fiet et al. | 343/771 |
| 2,724,774 | * | 11/1955 | Fiet | 343/771 |
| 3,149,336 | * | 9/1964 | Nikolayuk | 343/771 |
| 3,176,300 | * | 3/1965 | Kuecken | 343/771 |
| 3,340,534 | * | 9/1967 | Fee | 343/770 |
| 4,119,970 | | 10/1978 | Bogner et al. | 343/727 |
| 4,129,871 | | 12/1978 | Johns | 343/727 |
| 4,223,315 | | 9/1980 | Alford | 343/742 |
| 4,899,165 | | 2/1990 | Schadler | 343/767 |

* cited by examiner

*Primary Examiner*—Michael C. Wimer
(74) *Attorney, Agent, or Firm*—Pepper Hamilton LLP

(57) ABSTRACT

A multi-layered slotted antenna with reduced susceptance and increased conductance with a minimal effect on antenna radiation in the azimuth. Separate conductors are connected across the individual slots to reduce the slot susceptance with a minimal effect on slot radiation.

16 Claims, 3 Drawing Sheets

SLOT ANTENNA WITH SUSCEPTANCE REDUCING LOOPS

BACKGROUND OF THE INVENTION

1. Field of the Invention

This invention relates to an antenna for the broadcast of electromagnetic wave energy and, more particularly, to class of antennas known as slotted antennas.

2. Description of the Prior Art

Slotted antennas generally have a conductive mast that has a plurality of layers with one or more slots in each layer that are positioned along the axial direction of the mast. Slotted antennas have been used to radiate horizontally polarized waves for television applications. To impart elliptical or circular polarization, separate dipoles have been placed in juxtaposition to the slots. The dipoles are operable to provide a vertical component of radiation to the horizontal component provided by the slots. Examples of slotted antennas with elliptical polarization are disclosed in U.S. Pat. Nos. 4,129,871 and 4,899,165.

Some slotted antennas require a standing wave design. A standing wave design requires the admittance of each layer to add in parallel such that the resulting input admittance achieves a desired bandwidth at the antenna input. In order to achieve the best overall bandwidth at the antenna input, it is desirable to add up admittances of the layers along the real axis of the Smith chart. The slots of current standing wave antennas tend to have a high enough susceptance that it is difficult to achieve the best overall bandwidth at the antenna input.

An object of the present invention is to provide an antenna with reduced slot susceptance and improve antenna bandwidth.

SUMMARY OF THE INVENTION

An antenna according to the present invention includes a conductive mast having one or more slots that extend axially of the mast. A coupler is disposed within the mast to provide energy for exciting the slots to radiate waves of energy. Conductors are individually connected across the slots and positioned at a location of the mast that reduces the antenna susceptance and increases the antenna conductance with a minimal effect on the antenna radiation in the azimuth.

The conductors may extend across the slots perpendicularly to the axial direction of the mast or at an angle thereto. The location of the conductor relative to the slot is selected to give minimum susceptance and cause minimal effect to the radiation in the azimuth.

BRIEF DESCRIPTION OF THE DRAWINGS

Other and further objects, advantages and features of the present invention will be understood by reference to the following specification in conjunction with the accompanying drawings, in which like reference characters denote like elements of structure and.

DESCRIPTION OF THE INVENTION

Figure 1:
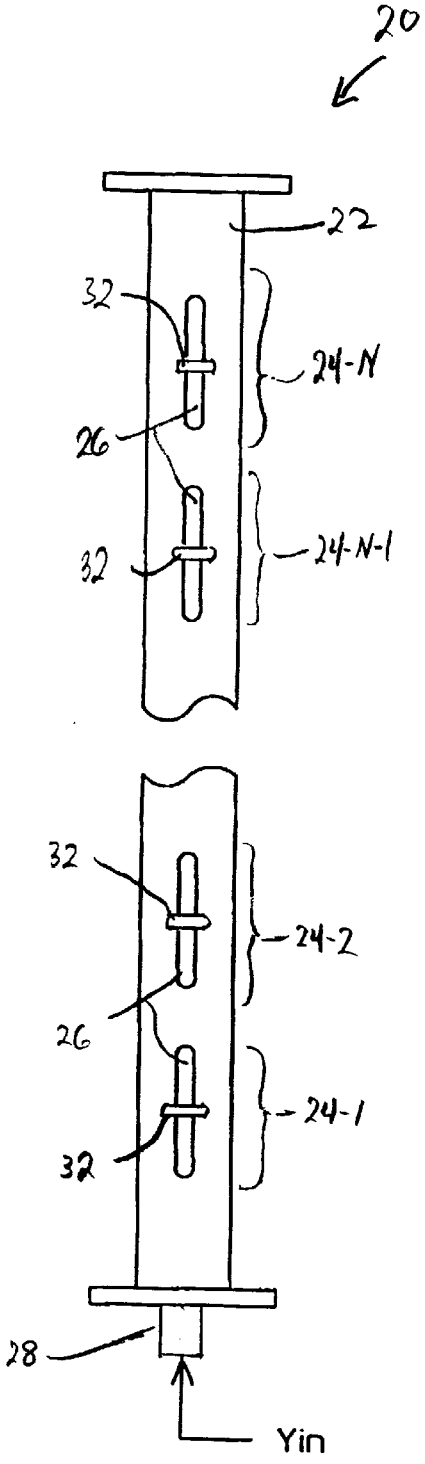
FIG. 1 is a schematic diagram in elevation of an antenna according to the invention.

With reference to FIG. 1, there is provided an antenna 20 according to the present invention. Antenna 20 includes a hollow conductive mast 22 that has a plurality of layers 24-1, 24-1 through 24-N–1 and 24-N. Each layer 24-1 through 24-N includes one or more slots that are located at the periphery of mast 22 and with their elongated dimension along the axial direction of mast 22. The number of slots per layer is a matter of choice of design and generally is dependent on the desired radiation pattern in the azimuth.

Mast 22 may have either a cylindrical construction for a coaxial mast or a non-cylindrical construction for a wave guide mast. For the purpose of description, mast 22 will be described for the coaxial construction. Mast 22 has an inner conductor 28 that is concentric with mast 22 and extends along the axis of mast 22. Antenna 20 receives a signal to be transmitted between inner conductor 28 and mast 22 at the bottom end of antenna 20. Antenna 20 is terminated at its top end with an impedance (not shown) connected between mast 22 and inner conductor 28. For a standing wave antenna, the terminating impedance is zero. That is, antenna 20 at its top end is shorted across mast 22 and inner conductor 28.

Figures 3, 4, 5:
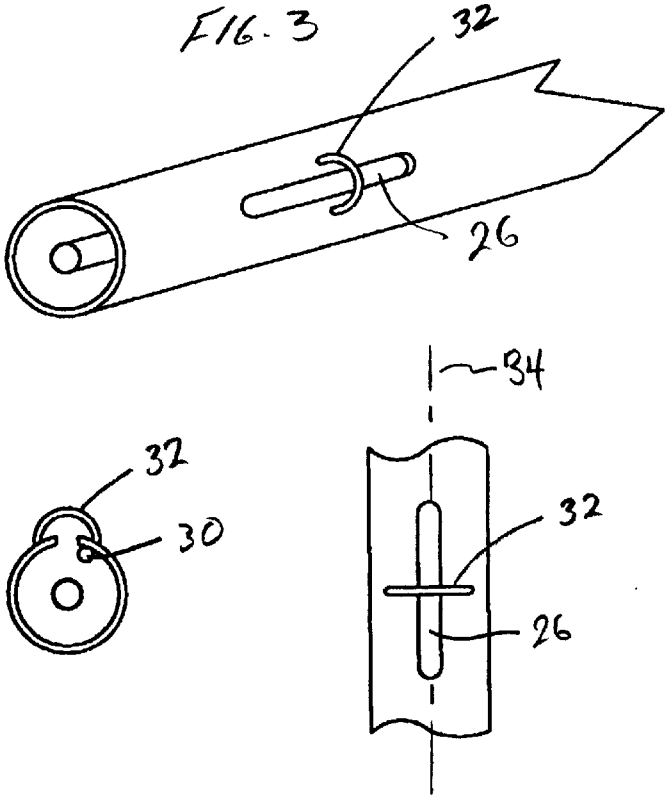
FIG. 3 is a perspective view of one layer of another antenna embodiment according to the invention.
FIG. 4 is a side view of the FIG. 3 antenna.
FIG. 5 is a top view of the FIG. 3 antenna.
Figures 6, 7, 8:
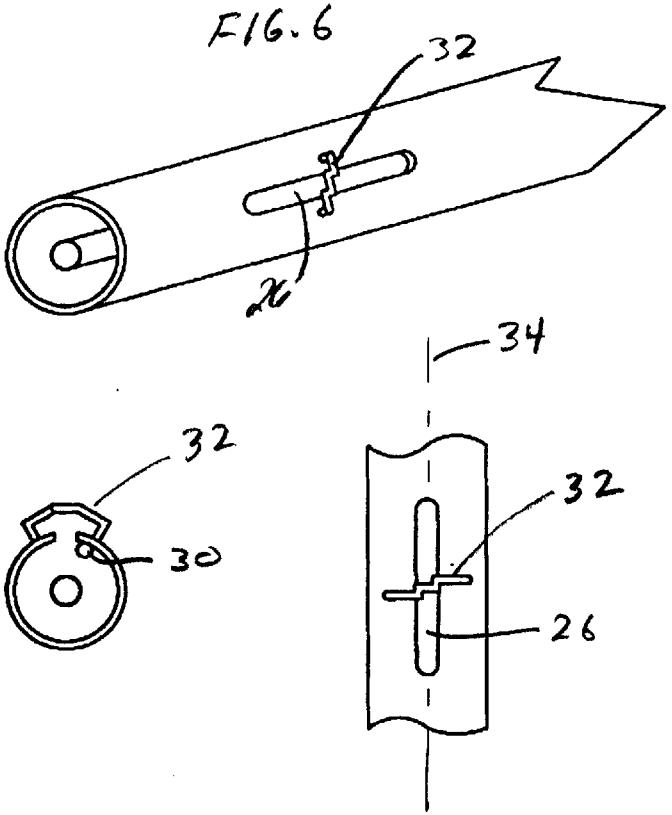
FIG. 6 is a perspective view of one layer of a further antenna embodiment according to the invention.
FIG. 7 is a side view of the FIG. 6 antenna.
FIG. 8 is top view of the FIG. 6 antenna.

Associated with each slot 26 is a coupler 30, shown only in FIGS. 4 and 7. Coupler 30 serves to provide excitation energy to slot 26 in the manner known in the art. Though not shown in the drawing figures, separate dipoles may be separately associated with slots 26. This would add a vertical radiation component to the horizontal radiation component provided by slots 26 so that antenna 20 will have elliptical or circular polarization.

Figure 2:
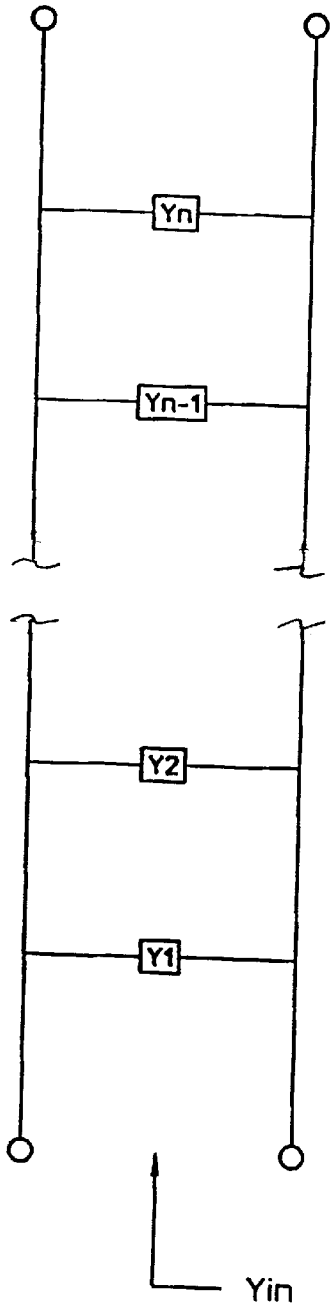
FIG. 2 is a schematic circuit diagram of the FIG. 1 antenna.

Referring to the schematic circuit diagram of FIG. 2, admittances Y1, Y2 through Yn–1 and Yn of slots 26 of layers 24-1, 24-2 through 24-N–1, respectively, are connected in parallel so as to be additive for an input admittance Yin.

According to the present invention, separate conductors 32 that are connected across slots 26 reduce the susceptance of slots 26. Conductors 32 are located at the periphery of mast 22 so as to provide a conductive connection across slots 26 without adding any radiation, particularly in the azimuth. That is, conductors 32 have minimal effect on the radiation produced by their respective slots. By reducing the susceptance, the admittance Yin is mostly a function of the slot conductance and, therefore achieves an optimum overall bandwidth for antenna 20.

With reference to FIGS. 3 through 8, conductor 32 is shown as being a loop. In FIGS. 3 through 5, the loop is arcuate, while in FIGS. 6 through 8, the loop is non-linear. Although conductor 32 is shown as located at substantially the midpoint of the associated slot 26, its position is optimally determined by a position that yields the lowest susceptance and the minimum radiation effect on the radiation produced by the associated slot. Conductors 32 may extend across slots 26 substantially perpendicular to an axial direction 34 of mast 22 as shown in FIGS. 1 and 3 through 5, or at an angle to axial direction 34 as shown in FIGS. 6 through 8.

The admittances, both conductance and susceptance were measured for a set of single layers without conductors 32 a set of single layers with conductors 32 at a frequency of 755 MHz. The layers of each set consisted of a mast having an inner conductor diameter of 6.125 inches, an outer mast diameter of 16 inches, a 2.25 inches thick wall and eight slots. Each set included separate layers with slot lengths of 9.5, 10 and 10.5 inches.

Figure 9:
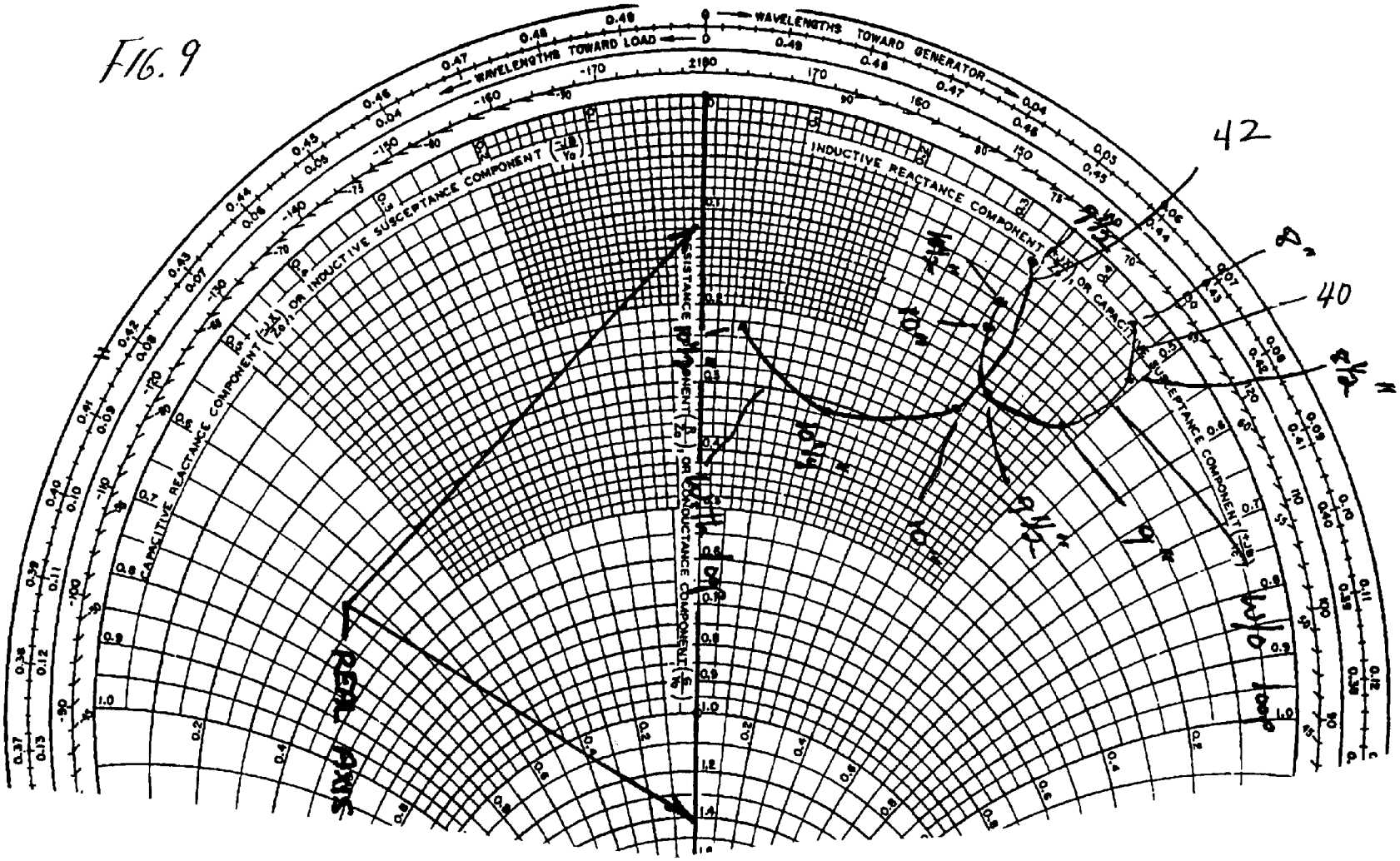
FIG. 9 is a portion of a Smith chart demonstrating the slot admittance with and without a conductor connected across the slot.

Referring to FIG. 9, curve 40 represents a plot of the admittance for the set of layers without conductors 32 and curve 42 represents a plot of admittance for the set of layers with conductors 32. By inspection, curve 42 for the set of layers with conductors 32 is closer to the real axis. Therefore, its slots have a lower susceptance. For example, the 10.5 inch slot without conductor 32 has a susceptance value of about 0.345 compared to a value of 0.05 with conductor 32. Also, the conductance is higher. Thus, the 10.5 inch slot without conductor 32 has a conductance value of 0.11 versus a value of about 0.23 with conductor 32.

The present invention having been thus described with particular reference to the preferred forms thereof, it will be obvious that various changes and modifications may be made therein without departing from the spirit and scope of the present invention as defined in the appended claims.

What is claimed is:

1. An antenna comprising:

a conductive mast having a slot extending in an axial direction at a periphery of the mast;

a coupler disposed within the mast to provide energy for exciting the slot to radiate waves of energy; and a conductor extending out of a plane of said slot and connected across the slot at a position away from an internal edge of said slot, and positioned at said periphery in a location that reduces a susceptance of the antenna with a minimal effect on the radiation of said waves of energy in the azimuth.

2. The antenna of claim 1, wherein the mast has a plurality of sections, wherein said slot is one of a plurality of slots, each section having at least one of the plurality of slots, and wherein said conductor is one of a plurality of conductors with each of the plurality of conductors being connected across separate ones of the slots.

3. The antenna of claim 2, wherein one or more of the plurality of conductors is a loop.

4. The antenna of claim 3, wherein the loop is arcuate.

5. The antenna of claim 3, wherein the loop is non-linear.

6. The antenna of claim 2, wherein one or more of the plurality of conductors extend across the slot substantially perpendicular to the axial direction of the mast.

7. The antenna of claim 2, wherein one or more of the plurality of conductors extend across the slot at an angle to the axial direction of the mast.

8. The antenna of claim 2, wherein the mast is cylindrical, thereby forming a coaxial antenna.

9. The antenna of claim 2, wherein the mast is non-cylindrical, thereby forming a wave guide.

10. The antenna of claim 2, wherein the impedance of each of the sections is selected to provide a standing wave antenna.

11. An antenna comprising:

a cylindrical conductive mast having a plurality of sections, each of the sections having a slot extending in an axial direction of the mast;

separate couplers disposed within the mast at locations to provide energy that excites separate ones of the slots to radiate waves of energy; and a plurality of conductors, separate ones of the plurality of conductors extending out of a plane of said slots and connected across separate ones of the slots at positions away from internal edges of said slots, and positioned at locations that reduce a susceptance of the antenna with a minimal effect on the radiation of the waves of energy in the azimuth.

12. The antenna of claim 11, wherein one or more of the plurality of conductors is a loop.

13. The antenna of claim 12, wherein the loop is arcuate.

14. The antenna of claim 12, wherein the loop is non-linear.

15. The antenna of claim 11, wherein one or more of the plurality of conductors extend across the slot substantially perpendicular to the axial direction of the mast.

16. The antenna of claim 11, wherein one or more of the plurality of conductors extend across the slot at an angle to the axial direction of the mast.

* * * * *